US005441763A

United States Patent [19]

Kuo

[11] Patent Number: 5,441,763

[45] Date of Patent: Aug. 15, 1995

[54] METHOD OF CORROSION PROTECTING STEEL STRUCTURAL COMPONENTS

[75] Inventor: Ming C. Kuo, Fox Point, Wis.

[73] Assignee: A.O. Smith Corporation, Milwaukee, Wis.

[21] Appl. No.: 223,331

[22] Filed: Apr. 5, 1994

[51] Int. Cl.[6] ..... B08B 7/00; B05D 3/12

[52] U.S. Cl. ..... 427/195; 427/327; 427/375; 134/7; 451/38; 451/39; 451/57

[58] Field of Search ..... 134/7; 51/318, 319; 451/38, 39, 57; 427/327, 195, 375; 156/153

[56] References Cited

U.S. PATENT DOCUMENTS

| | | | |
|---|---|---|---|
| H974 | 11/1991 | Mizobuchi et al. | 29/898 |
| 3,073,022 | 1/1963 | Bush et al. | 29/553 |
| 3,700,505 | 10/1972 | Kanter | 148/276 X |
| 3,754,976 | 8/1973 | Babecki et al. | 117/105 |
| 4,250,726 | 2/1981 | Safian et al. | 72/38 |
| 4,581,913 | 4/1986 | Reed | 72/53 |
| 4,753,094 | 6/1988 | Spears | 72/53 |
| 5,057,108 | 10/1991 | Shetty et al. | 606/53 |
| 5,230,815 | 7/1993 | Rountree | 252/25 |

OTHER PUBLICATIONS

"Glass Bead Inpact Blasting", by Woelfel & Mulhall, *Metal Progress*, 9-82, pp. 57-59.

*Primary Examiner*—David A. Simmons
*Assistant Examiner*—Sean Vincent
*Attorney, Agent, or Firm*—James Earl Lowe, Jr.

[57] ABSTRACT

A method of corrosion protecting steel structural components, such as motor vehicle structural frames and engine cradles, the method comprising: a steel shot blast mechanical cleaning of the steel structural component to remove scale, rust, and other oxidation residues, then an aluminum oxide shot blast mechanical cleaning of the steel structural component to remove any residual ferrous material, to flatten any undesirable metal peaks, and to leave a thin layer of aluminum oxide on the component, then the application of a powder paint, and then baking the steel structural component.

14 Claims, 2 Drawing Sheets

METHOD OF CORROSION PROTECTING STEEL STRUCTURAL COMPONENTS

BACKGROUND OF THE INVENTION

The invention relates to a method of corrosion protecting steel structural components. More particularly, the invention relates to a method of corrosion protecting motor vehicle structural frames and engine cradles.

Prior to the invention, the corrosion protection of steel components, such as motor vehicle structural frames and engine cradles involved several expensive treatments. As illustrated in FIG. 1, first the component was treated by a steel shot blast mechanical cleaning of the steel structural component to remove scale, rust, and other oxidation residues, and to harden the steel. Then an alkaline wash, a rinse water wash, a phosphate, iron or zinc treatment, and another rinse water wash occurred. Then a non-chrome seal rinse, such as a water soluble polymer rinse, a deionized water rinse, drying, cool down, the application of a relatively thick powder paint film, and the baking of the steel component completed the process. The component was then unloaded and sent on to the customer. The relatively thick powder paint film was required in order to cover the rough surface profile (metal peaks of about 3.5 mil) of the steel left behind by the steel shot. This thick film coating increased the cost of this corrosion method. In addition, the use of the chemical treatments increased cost as well as produced waste disposal problems.

SUMMARY OF THE INVENTION

The invention provides a method of corrosion protecting steel structural components, such as motor vehicle structural frames and engine cradles, the method comprising: a steel shot blast mechanical cleaning of the steel structural component to remove scale, rust, and other oxidation residues, then a glass shot blast mechanical cleaning of the steel structural component to remove any residual ferrous material, and to flatten any undesirable metal peaks, then the application of a corrosion protective coating, and then the set-up of the protective coating.

In one embodiment of the invention, the glass is aluminum oxide, which leaves a thin layer of aluminum oxide on the component, the corrosion protective coating is a powder paint, and the set-up of the powder paint comprises baking the steel structural component.

One of the principal features of the invention is the provision of a less expensive method of corrosion protecting steel structural components, while at the same time offering better corrosion protection. This is accomplished by improving the steel surface profile (metal peaks of 1 to 1.5 mil), which reduces subsequent corrosion action, by optimizing paint usage since it is no longer necessary to use a thick film to cover metal peaks, by the addition of the aluminum oxide film, which provides further corrosion protection, by achieving additional steel strength enhancement through the second shot peening, by having faster production rates by reducing the number of steps involved, by needing less costly facilities and equipment and space, and by freeing the steel surface of any possible ferrous residue.

Other features and advantages of the invention will become apparent to those skilled in the art upon review of the following detailed description, claims and drawings.

Figure 1:
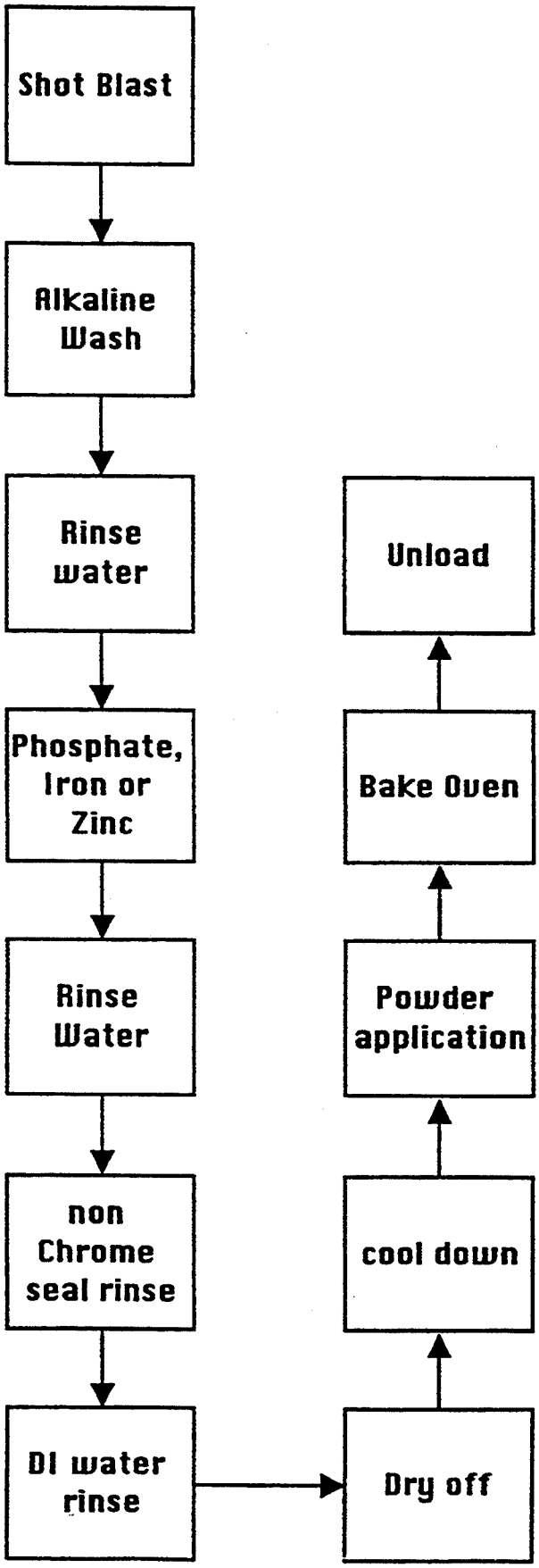
Fig. 1 (Prior art)
FIG. 1 is a schematic illustration of the prior art method of corrosion protecting steel structural components.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION OF THE PREFERRED EMBODIMENTS

Figure 2:
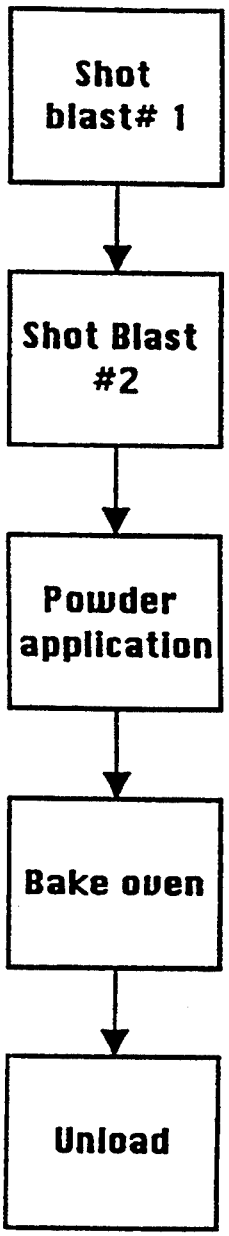
FIG. 2 is a schematic illustration of the method of corrosion protecting steel structural components according to the invention.

As illustrated in FIG. 2, the invention provides a method of corrosion protecting steel structural components, such as motor vehicle structural frames and engine cradles. The method comprises: a steel shot blast mechanical cleaning of the steel structural component to remove scale, rust, and other oxidation residues, then a glass, such as aluminum oxide, shot blast mechanical cleaning of the steel structural component to remove any residual ferrous material, to flatten any undesirable metal peaks, and to leave a thin layer of aluminum oxide on the component. Suitable shot blasting processes are disclosed in U.S. Pat. No. 5,057,108, which is incorporated herein by reference. The next step is the application of a corrosion protective coating, and then the set-up of the protective coating.

In one embodiment of the invention, the corrosion protective coating is a powder paint, as is well known in the art, and the set-up of the powder paint comprises baking the steel structural component.

Various features of the invention are set forth in the following claims.

What is claimed is:

1. A method of corrosion protecting steel structural components, the method comprising:

a steel shot blast mechanical cleaning of the steel structural component to remove scale, rust, and other oxidation residues, then a glass shot blast mechanical cleaning of the steel structural component to remove any remaining said residues, and to flatten any undesirable metal peaks, then the application of a corrosion protective coating, and then the curing of the protective coating, wherein said method is performed without chemical treatment of the steel structural component prior to the application of said protective coating.

2. A method according to claim 1 wherein said corrosion protective coating is a powder paint.

3. A method according to claim 2 wherein said curing of said powder paint comprises baking the steel structural component.

4. A method according to claim 1 wherein said glass is aluminum oxide, which leaves a thin layer of aluminum oxide on the component.

5. A method according to claim 1 wherein steel and glass shot blast cleanings leave metal peaks of not more than approximately 1.5 mil.

6. A method according to claim 5 wherein said steel and glass shot blast cleanings leave metal peaks of approximately 1 to 1.5 mil.

7. A method according to claim 1 wherein said method is performed without rinsing the steel structural component.

8. A method of corrosion protecting steel structural components, the method consisting essentially of:

a steel shot blast mechanical cleaning of the steel structural component to remove scale, rust, and other oxidation residues, then a glass shot blast mechanical cleaning of the steel structural to remove any remaining said residues, and to flatten any undesirable metal peaks, then the application of a corrosion protective coating, and then the curing of the protective coating.

9. A method according to claim 8 wherein said corrosion protective coating is a powder paint.

10. A method according to claim 9 wherein said curing of said powder paint comprises baking the steel structural component.

11. A method according to claim 8 wherein said glass is aluminum oxide, which leaves a thin layer of aluminum oxide on the component.

12. A method according to claim 8 wherein said steel and glass shot blast cleanings leave metal peaks of not more than approximately 1.5 mil.

13. A method according to claim 12 wherein steel and glass shot blast cleanings leave metal peaks of approximately 1 to 1.5 mil.

14. A method of corrosion protecting steel structural components, the method comprising:

a steel shot blast mechanical cleaning of the steel structural component to remove scale, rust, and other oxidation residues, then a glass shot blast mechanical cleaning of the steel structural component to remove any remaining said residues, and to flatten any undesirable metal peaks, said glass being aluminum oxide, which leaves a thin layer of aluminum oxide on the component, and said steel and glass shot blast cleanings leaving metal peaks of approximately 1 to 1.5 mil, then the application of a corrosion protective powder paint coating, and then the curing of the protective coating by baking the steel structural component, said method being performed without rinsing the steel structural component and without chemical treatment of the steel structural component prior to the application of said protective coating.

* * * * *